US011530078B2

(12) United States Patent
Lee

(10) Patent No.: US 11,530,078 B2
(45) Date of Patent: Dec. 20, 2022

(54) CONTENTS CONTAINER

(71) Applicant: YONWOO CO., LTD., Incheon (KR)

(72) Inventor: Kang Jin Lee, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 17/621,393

(22) PCT Filed: Sep. 28, 2021

(86) PCT No.: PCT/KR2021/013187
§ 371 (c)(1),
(2) Date: Dec. 21, 2021

(87) PCT Pub. No.: WO2022/092584
PCT Pub. Date: May 5, 2022

(65) Prior Publication Data

US 2022/0212842 A1 Jul. 7, 2022

(30) Foreign Application Priority Data

Oct. 27, 2020 (KR) ..... 10-2020-0140747

(51) Int. Cl.
*B65D 47/18* (2006.01)
*A45D 34/04* (2006.01)
*A45D 40/26* (2006.01)

(52) U.S. Cl.
CPC ..... *B65D 47/18* (2013.01); *A45D 34/04* (2013.01); *A45D 40/26* (2013.01)

(58) Field of Classification Search
CPC ..... B65D 47/18; A45D 34/04; A45D 40/26; B01L 3/0272
USPC ..... 222/420, 421, 207, 209, 211–214; 141/22–25; 604/212, 217
See application file for complete search history.

(56) References Cited

U.S. PATENT DOCUMENTS 1,870,780 A * 8/1932 Milburn ..... B01L 3/0282 422/934
2,058,516 A * 10/1936 Schaaff ..... B01L 3/0282 422/934

(Continued)

FOREIGN PATENT DOCUMENTS

KR 10-1202092 B1 11/2012
KR 10-1465886 B1 11/2014

(Continued)

*Primary Examiner* — Lien M Ngo
(74) *Attorney, Agent, or Firm* — Bridgeway IP Law Group, PLLC; Sang Ho Lee; Hyun Woo Shin

(57) ABSTRACT

Provided is a contents container including a container body in which contents are stored and from which a neck portion having an open upper surface protrudes upward; and a discharge portion separably coupled to neck portion of the container body. Here, the discharge portion includes a pipette portion inserted into the container body through the neck portion and configured to suction in and discharge the contents, a cap portion formed above the pipette portion and detachably coupled to the neck portion so as to seal the container body, and a pressurizing portion formed above the cap portion and configured to generate a change in pressure for suctioning and discharging the contents into and from the pipette portion. Also, the discharge portion is formed of the same type of material.

18 Claims, 4 Drawing Sheets

(56) References Cited

U.S. PATENT DOCUMENTS

| | | | | | |
|---|---|---|---|---|---|
| 2,651,437 | A * | 9/1953 | Fields | B01L 3/0282 | 422/934 |
| 2,789,735 | A * | 4/1957 | Olson et al. | B01L 3/0282 | 422/934 |
| 2,800,253 | A * | 7/1957 | Henderson | B01L 3/0282 | 422/934 |
| 2,872,950 | A * | 2/1959 | Castelli | B01L 3/0282 | 422/934 |
| 3,135,302 | A * | 6/1964 | Ballin | B01L 3/0282 | 422/933 |
| 4,416,400 | A * | 11/1983 | Dougherty, Sr. | B01L 3/0282 | 422/934 |
| 7,434,602 | B2 * | 10/2008 | Barone | B65D 47/18 | 141/22 |
| 2001/0035432 | A1 * | 11/2001 | Buehler | B01L 3/0282 | 222/206 |
| 2019/0166975 | A1 * | 6/2019 | Hong | B65D 43/165 | |

FOREIGN PATENT DOCUMENTS

| | | | |
|---|---|---|---|
| KR | 10-2018-0001687 | A | 1/2018 |
| KR | 30-1063176 | S | 6/2020 |

* cited by examiner

CONTENTS CONTAINER

TECHNICAL FIELD

The present invention relates to a cosmetic container, and more particularly, to a contents container in which a discharge portion and/or container body is formed of the same material.

BACKGROUND ART

Up until now, a cosmetics container has been configured so that cosmetics are accommodated in a container body and the container body is opened or closed using a lid so as to take the cosmetics out of the container body when the container body is opened and to apply the cosmetics to the skin. However, in this case, since it is difficult to adjust an amount of cosmetics discharged from the container body, there is a problem of wasting the cosmetics.

In order to remedy the above problem, in order to use highly functional cosmetics such as essence and the like of which a fixed amount needs to be used, pipette type containers capable of extracting a fixed amount of cosmetics from an inside of a contents container have been developed.

A pipette type container generally includes a container body in which contents are accommodated, a cap portion configured to seal the container body, a pipette portion coupled to the cap portion, inserted into the container body, and configured to suction and discharge the contents accommodated in the container body, a pressurizing portion coupled to an upper side of the pipette portion and configured to cause a change in pressure inside the pipette portion, and the like.

However, the pipette type container includes one or more components embodied using a plurality of different materials, and thus there is an inconvenience of separating components when the container is discarded. Also, since it is necessary to separately mold and assemble the pipette portion, pressurizing portion, cap portion, and the like, a configuration of a product becomes complicated and manufacturing costs increase.

Accordingly, a cosmetics container capable of remedying such problems is required.

DISCLOSURE

Technical Problem

The present invention is directed to providing a contents container in which a discharge portion and/or container body is formed of the same type of material so as to be easily reused and eco-friendly and a cap portion and a pressurizing portion of the discharge portion are integrally formed through double injection molding so as to reduce manufacturing costs.

It should be noted that technical objects of the present invention are not limited to the above-described object, and other objects of the present invention will be apparent to those skilled in the art from the following descriptions.

Technical Solution

According to an aspect of the present invention, there is provided a contents container. The contents container includes a container body in which contents are stored and from which a neck portion having an open upper surface protrudes upward; and a discharge portion separably coupled to neck portion of the container body. Here, the discharge portion includes a pipette portion inserted into the container body through the neck portion and configured to suction in and discharge the contents, a cap portion formed above the pipette portion and detachably coupled to the neck portion so as to seal the container body, and a pressurizing portion formed above the cap portion and configured to generate a change in pressure for suctioning and discharging the contents into and from the pipette portion. Also, the discharge portion is formed of the same type of material.

The cap portion and the pressurizing portion may be integrally formed through double injection molding.

The discharge portion may be formed of a polypropylene-based material.

A coupling portion to be coupled to the cap portion may be formed on an upper end of the pipette portion. Here, the coupling portion may include a mounting portion formed to protrude outward along an edge of the upper end of the pipette portion and to have an outer diameter greater than an inner diameter of the neck portion and a bending portion formed to extend upward to a certain height along an outer perimeter of the mounting portion. Also, when the contents container and the discharge portion are coupled, the mounting portion may be mounted on an upper end of the neck portion.

The cap portion may include a first edge extending downward from an inside-upper surface thereof and a second edge extending downward from the inside-upper surface and disposed to be spaced outward apart from the first edge. Here, the bending portion may be inserted into and coupled to a space between the first edge and the second edge so as to detachably couple the cap portion and the pipette portion to each other.

The cap portion may include a third edge disposed to be spaced outward apart from the second edge and extending downward from a perimeter of the upper surface. Here, the cap portion may be coupled to the neck portion so that a lower end of the third edge may be mounted on an upper end of the contents container.

An inside of the pressurizing portion may communicate with an internal space of the first edge. Here, the inside of the pressurizing portion and an inside of the pipette portion may communicate with each other when the cap portion and the pipette portion are coupled to each other.

Advantageous Effects

According to the present invention, since a discharge portion and/or container body is formed of the same polypropylene-based material, a container may be discarded without needing to be separately disposed of and easily reused.

Also, according to the present invention, since a cap portion and a pressurizing portion are integrally formed through double injection molding, a configuration of container may be simplified and manufacturing costs may be reduced.

Also, according to the present invention, the pressurizing portion may be molded to have a variety of shapes so as to provide users with a variety of types of aesthetics.

DESCRIPTION OF DRAWINGS

A brief description of the drawings will be provided to more fully understand the drawings referred to in the detailed description of the present invention.

MODES OF THE INVENTION

Figure 1A:
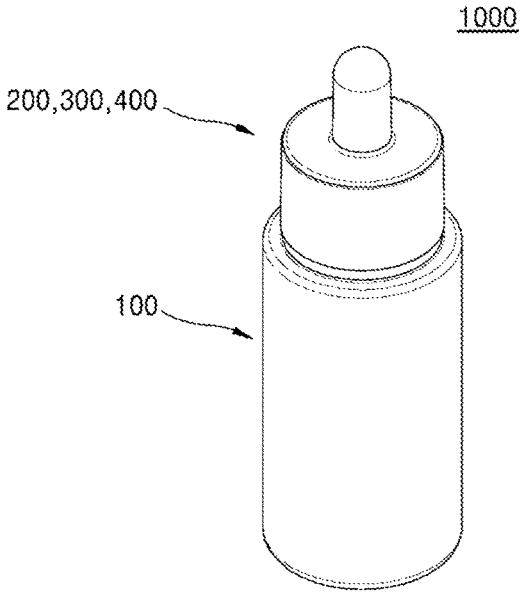
FIGS. 1A and 1B are perspective views of a contents container according to one embodiment of the present invention.

Hereinafter, embodiments of the present invention will be described with reference to the attached drawings. While reference numerals are given to components of each drawing, it should be noted that although shown in different drawings, like components will be referred to as like reference numerals if possible. Also, in a description of the embodiments of the present invention, a detailed description of well-known components or functions of the related art will be omitted when it is deemed to obscure understanding of the embodiments of the present invention. Also, although the embodiments of the present invention will be described below, the technical concept of the present invention is not limited or restricted thereto and a variety of modifications thereof may be made by one of ordinary skill in the art. Meanwhile, vertical and lateral directions which will be described below are on the basis of the drawings for convenience, and the scope of the present invention is not limited to the corresponding directions.

Throughout the specification, when a part is stated as being "connected" to another part, the part is not only "directly connected" but also "indirectly connected" to the other component with another device therebetween. Throughout the specification, when a portion is stated as "including" a component, unless defined particularly otherwise, it means that the portion may not exclude another component but may further include another component. Also, in describing components of the embodiments of the present invention, the terms such as first, second, A, B, (a), (b), and the like may be used. These terms are merely for distinguishing one element from another, and the essential, order, sequence, and the like of corresponding elements are not limited by the terms.

Figure 1B:
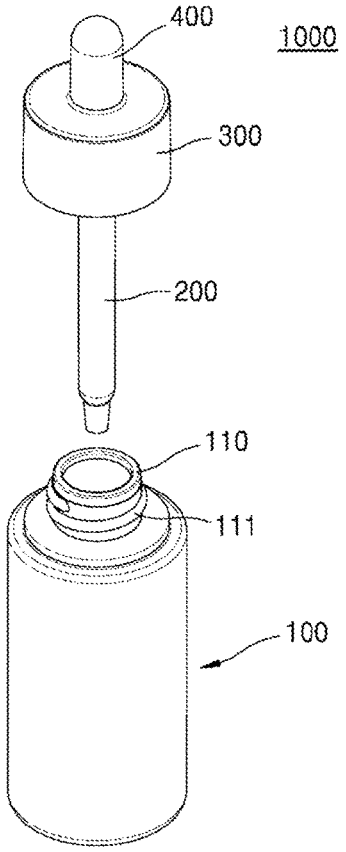
Figure 2:
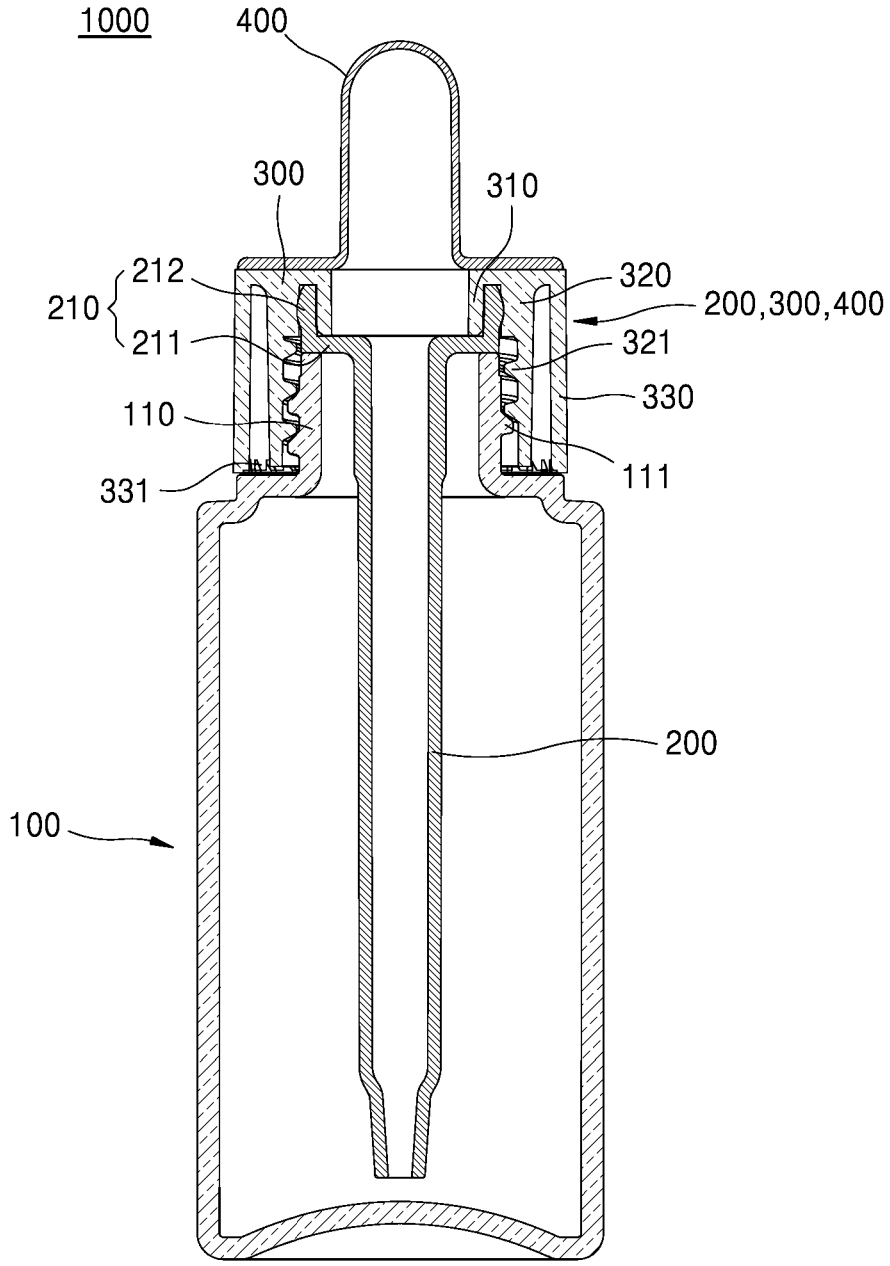
FIG. 2 is a cross-sectional view of the contents container according to one embodiment of the present invention.
Figure 3:
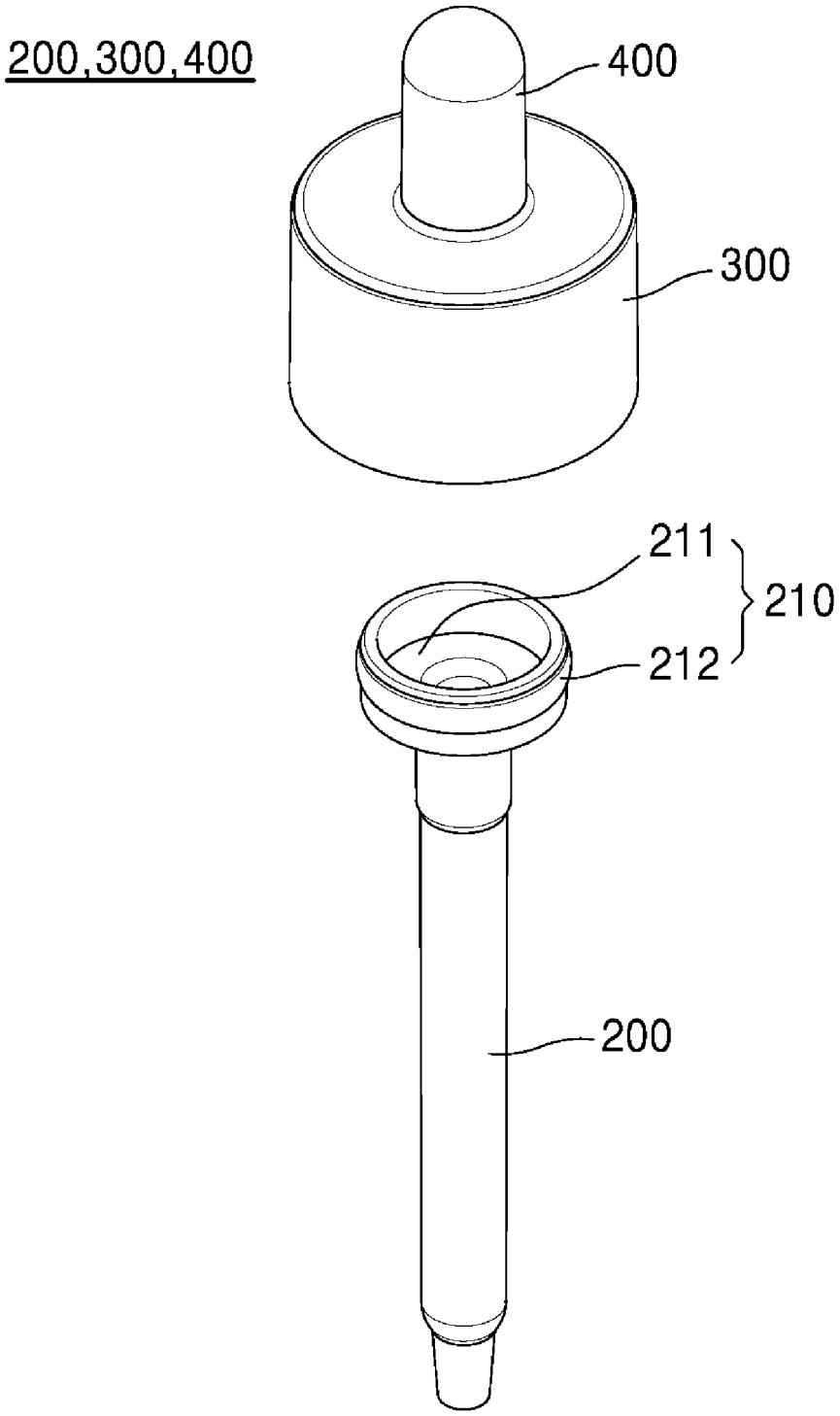
FIG. 3 is an exploded perspective view illustrating a discharge portion according to one embodiment of the present invention.
Figure 4:
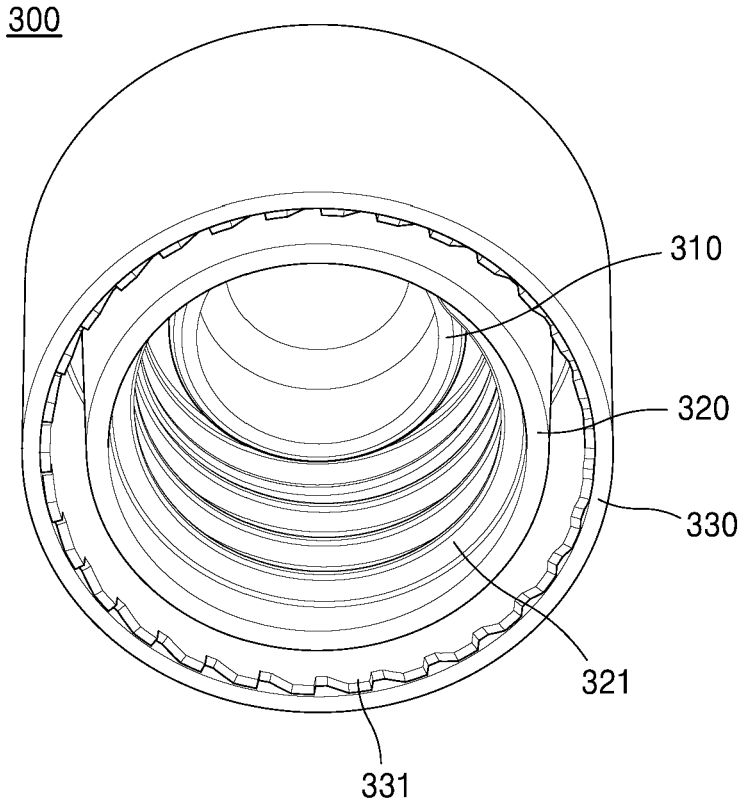
FIG. 4 is a perspective view illustrating a cap portion from below according to one embodiment of the present invention.

FIGS. 1A and 1B are perspective views of a contents container according to one embodiment of the present invention. In detail, FIG. 1A illustrates a state in which a contents body and a discharge portion of the contents container are coupled to each other, and FIG. 1B illustrates a state in which the contents body and the discharge portion of the contents container are separated from each other. FIG. 2 is a cross-sectional view of the contents container according to one embodiment of the present invention, FIG. 3 is an exploded perspective view illustrating the discharge portion according to one embodiment of the present invention, and FIG. 4 is a perspective view illustrating a cap portion from below according to one embodiment of the present invention.

Referring to FIGS. 1A to 4, a contents container 1000 may include a container body 100 and a discharge portion 200, 300, and 400.

The container body 100 may accommodate contents therein and include a neck portion 110 having an open upper surface and protruding upward from an upper end thereof so that a pipette portion 200 configured to discharge the contents may be inserted into and withdrawn from the container body 100. Here, the contents accommodated in the container body 100 may be, for example, liquid or gel type cosmetics such as serum, essence, cream, and the like. However, the present invention is not limited thereto, and a variety of other formulations or a variety of types of contents such as medications or sanitary aids which are dischargeable through the pipette portion 200 may be applied.

In one embodiment, the container body 100 may be formed of a polypropylene material. However, the present invention is not limited thereto, and a variety of materials may be applied.

In one embodiment, at least a part of the container body 100 may be formed of a transparent or semitransparent material. Accordingly, a user may see a remaining amount of the contents stored in the container body 100 with the naked eye.

A cap portion 300 may be detachably coupled to the neck portion 110. To this end, a first screw thread 111 may be formed on an outer circumferential surface of the neck portion 110 and a second screw thread 321 corresponding thereto may be formed inside the cap portion 300. For example, according to unidirectional rotation, since the cap portion 300 is screw-coupled to the neck portion 110, the cap portion 300 may be detachably coupled to the container body 100. However, this coupling method is merely an example, and the present invention is not limited thereto. In addition thereto, the neck portion 110 and the cap portion 300 may be coupled to each other through a variety of coupling methods such as a snap-on method and the like.

As one embodiment, a wiper (not shown), which is configured to push contents coated on an outer surface of the pipette portion 200 into the container body 100 when the pipette portion 200 is withdrawn, may be further provided inside the container body 100. For example, the wiper may be formed to extend downward from one region of an inner surface of the neck portion 110 and may include a through hole in a center thereof. While the discharge portion 200, 300, and 400 is coupled and separated, the pipette portion 200 may be inserted into or withdrawn from the container body 100 through the through hole. The wiper may be formed of the same type of material as those of the container body 100 and/or the discharge portion 200, 300, and 400, for example, a polypropylene-based material. However, the present invention is not limited thereto, and a variety of materials may be applied according to an embodiment of the present invention.

The discharge portion 200, 300, and 400 may include the pipette portion 200, the cap portion, and a pressurizing portion 400.

The pipette portion 200 may be inserted into and withdrawn from the container body 100 and may suction and discharge the contents of the container body 100. For example, the pipette portion 200 may include a hollow therein and suction the contents in according to a change in pressure thereinside, and the user may withdraw the pipette portion 200 in which the contents has been suctioned from the container body 100 and discharge the contents to the skin.

The pipette portion 200 may be detachably coupled to the cap portion 300 through a coupling portion 210 formed on an upper end thereof. Accordingly, the user may easily assemble the pipette portion 200 with the cap portion 300, may separate or remove one of the pipette portion 200 and the cap portion 300, or may replace the pipette portion 200 or the cap portion 300 with another.

The coupling portion 210 may include a mounting portion 211 and a bending portion 212.

The mounting portion 211 may be formed to protrude outward along an edge of the upper end of the pipette portion 200. Here, the mounting portion 211 may be formed to have an outer diameter greater than an inner diameter of the neck portion 110 so as to be mounted on an upper end of the neck portion 110 when the container body 100 and the discharge portion 200, 300, and 400 are coupled. For example, when the discharge portion 200, 300, and 400 is coupled to the container body 100, the mounting portion 211 may pressurize the upper end of the neck portion 110 downward while being mounted on the upper end of the neck portion 110 and may be completely pressed against an upper end surface of the neck portion 110. Accordingly, even without additional particular components, the neck portion 110 may be firmly sealed. In some embodiments, at least a part of a lower surface of the mounting portion 211 may be formed of soft or elastic material in order to increase a sealing force.

The bending portion 212 may be formed to extend upward, to a certain height, from an outer perimeter of the mounting portion 211 and may be inserted into and coupled to a space between a first edge 310 and a second edge 320 of an inside of the cap portion 300. Here, the bending portion 212 is formed to have a height corresponding to the first edge 310 and may include at least one region having a thickness greater than the space between the first edge 310 and the second edge 320. Accordingly, the bending portion 212 is completely pressed against the space between the first edge 310 and the second edge 320 so as to allow the pipette portion 200 and the cap portion 300 to be firmly coupled.

In some embodiments, a coupling protrusion and/or a coupling groove which are configured to increase a coupling force may be further formed on an inner circumferential surface and/or an outer circumferential surface of the bending portion 212, an outer circumferential surface of the first edge 310, and/or an inner circumferential surface of the second edge 320.

In one embodiment, at least a part of the pipette portion 200 may be formed of a transparent material. Accordingly, the user may see an amount, color, and the like of the contents suctioned in the pipette portion 200.

The cap portion 300 may be detachably coupled to the neck portion 110 so as to seal the container body 100. Also, when the coupling portion 210 of the pipette portion 200 is coupled to an inside of the cap portion 300 and the cap portion 300 is coupled to the container body 100, the pipette portion 200 may be accommodated in the container body 100.

Inside the cap portion 300, the first edge 310 extending downward from an upper surface and the second edge 320 extending downward from the upper surface and disposed to be spaced apart from an outside of the first edge 310 may be formed. The cap portion 300 and the pipette portion 200 may be detachably coupled by inserting and coupling the bending portion 212 into and to the space between the first edge 310 and the second edge 320.

A second screw thread 321 having a shape corresponding to the first screw thread 111 of the neck portion 110 may be formed on an inner surface of the second edge 320. Accordingly, the cap portion 300 may be screw-coupled to the neck portion 110. Accordingly, through unidirectional rotation of the cap portion 300, the container body 100 and the discharge portion 200, 300, and 400 may be coupled and/or separated. However, the present invention is not limited thereto, and a variety of coupling methods such as coupling using a coupling protrusion and a coupling groove formed instead of the first screw thread 111 and the second screw thread 321 and the like may be applied in some embodiments of the present invention.

The cap portion 300 may include a third edge 330 disposed to be spaced outward apart from the second edge 320 and extending downward from a perimeter of the upper surface. The third edge 330 may form an outer surface of the cap portion 300, may be a part grippable when the user separates or couples the discharge portion 200, 300, and 400 from or to the container body 100, and may prevent the second edge 320 coupled to the neck portion 110 from being directly exposed to the outside so as to prevent the second edge 320 from being damaged.

When the neck portion 110 and the cap portion 300 are coupled, the third edge 330 may be mounted on the upper end of the container body 100. For example, the container body 100 may include a restricting step (with no reference numeral) protruding upward along an edge of a lower end of the neck portion 110 and configured to allow the third edge 330 to be mounted on top of the restricting step when the neck portion 110 is completely sealed through the unidirectional rotation of the cap portion 300.

As one embodiment, one or more restricting protrusions 331 may be formed along a perimeter of an inner circumferential surface of a lower end of the third edge 330. For example, the restricting protrusion 331 may be formed to protrude inward from the third edge 330 and to have one side having a repeated saw-toothed shape tilted at a certain angle. When the user excessively rotates the cap portion 300 during a process of coupling the cap portion 300, the restricting protrusion 331 may come into contact with the restricting step and may allow the user to recognize a coupling state of the cap portion 300.

In one embodiment, one or more holding protrusions (not shown) may be formed on the restricting step. When the cap portion 300 rotates in one direction and thus the third edge 330 reaches a certain height from the restricting step, the holding protrusion may be held between the restricting steps so as to prevent the cap portion 300 from additional rotation in one direction.

The pressurizing portion 400 may be formed above the cap portion 300 and may generate a change in pressure to allow the contents to be suctioned in and discharged from the pipette portion 200. To this end, an inside of the pressurizing portion 400 may communicate with the inside of the pipette portion 200. For example, the pressurizing portion 400 may be formed to communicate with an internal space of the first edge 310 so that the inside of the pressurizing portion 400 may communicate with the inside of the pipette portion 200 when the bending portion 212 of the pipette portion 200 is inserted into and coupled to the space between the first edge 310 and the second edge 320 of the cap portion 300.

The pressurizing portion 400 may be formed to be elastically deformable according to pressurization of the user. For example, when the cap portion 300 and the pressurizing portion 400 are integrally molded, the pressurizing portion 400 may be molded to have a thickness capable of having elasticity. Accordingly, according to pressurizing and releasing of the user, a volume inside the pressurizing portion 400 may be reduced or increased so as to generate a change in internal pressure of the pipette portion 200.

According to one embodiment, the pressurizing portion 400 may be formed to have a variety of shapes. Since the discharge portion 200, 300, and 400 may generate a change in pressure inside the pipette portion 200 through an internal space of the pressurizing portion 400 and an internal space of the first edge 310, a variety of shapes in which a volume of the internal space of the pressurizing portion 400 is changeable may be applied. For example, the pressurizing portion 400 is formed to have a button shape, or a variety of other shapes such as a quadrangular shape, a triangular shape, and the like are applied to the pressurizing portion 400 so that a variety of types of aesthetics may be provided to the user.

The discharge portion 200, 300, and 400 may be formed of a polypropylene-based material. Particularly, the pressurizing portion 400 may be formed of a polypropylene material in which polyolefin elastomer (POE) is mixed to have elasticity of a certain degree or higher. However, the present invention is not limited thereto, and a variety of materials may be applied. Particularly, the cap portion 300 and the pressurizing portion 400 are formed of the same polypropylene-based materials and integrally formed through double injection molding so that a configuration of a container may be simplified and manufacturing costs may be reduced.

According to an embodiment, the container body 100 and the discharge portion 200, 300, and 400 may be formed of the same types of materials. Here, the container body 100 and the discharge portion 200, 300, and 400 are formed of polypropylene-based materials so that there is an advantage of disposing a container without needing to be separately disposed. However, the present invention is not limited thereto, and a variety of materials may be applied according to an embodiment to which the present invention is applied.

As described above, optimum embodiments have been shown and described in the drawings and the specification. The particular terms used herein are merely intended to describe the present invention and are not used to limit the meanings or restrict the scope of the present invention disclosed in the claims. Therefore, it should be understood by one of ordinary skill in the art that a variety of modifications and equivalents thereof may be made. Accordingly, the technical scope of the present invention should be determined by the technical concept of the following claims.

The invention claimed is:

1. A contents container comprising:

a container body made of polypropylene (PP)-based materials in which contents are stored and from which a neck portion having an open surface extends in a first direction; and a discharge portion separably coupled to the neck portion of the container body, wherein the discharge portion comprises:

a pipette portion inserted into the container body through the neck portion and configured to suction in and discharge the contents;

a cap portion disposed on the pipette portion and detachably coupled to the neck portion and the cap portion configured to seal the container body; and a pressurizing portion disposed on the cap portion and configured to suction and discharge the contents into and from the pipette portion, and wherein the container body, the pipette portion, the cap portion, and the pressurizing portion are made of the same type of polypropylene (PP)-based materials, and the pressurizing portion is made of the polypropylene (PP)-based materials mixed with polyolefin elastomers (POE) having a higher elasticity compared to the container body, the pipette portion, and the cap portion.

2. The contents container of claim 1, wherein the cap portion and the pressurizing portion are integrally formed.

3. The contents container of claim 1, wherein a coupling portion to be coupled to the cap portion is disposed on an one end of the pipette portion, wherein the coupling portion comprises:

a mounting portion extending normal to the first direction along an edge of the one end of the pipette portion and having an outer diameter greater than an inner diameter of the neck portion, and a bending portion extending in the first direction to a predetermined height along an outer perimeter of the mounting portion, and wherein when the container body and the discharge portion are coupled, the mounting portion is mounted on an one end of the neck portion.

4. The contents container of claim 3, wherein the cap portion comprises:

a first edge extending in a second direction from an inside surface of the cap portion and wherein the second direction is opposite to the first direction and a second edge extending in the second direction from the inside surface of the cap portion and disposed to be spaced outward apart from the first edge, and wherein the bending portion is detachably inserted into and coupled to a space between the first edge and the second edge.

5. The contents container of claim 4, wherein the cap portion further comprises a third edge disposed to be spaced outward apart from the second edge and extending in the second direction, and wherein the cap portion is coupled to the neck portion and an end of the third edge is mounted on an end of the container body.

6. The contents container of claim 4, wherein an inside of the pressurizing portion communicates with an internal space of the first edge, and wherein the inside of the pressurizing portion and an inside of the pipette portion communicate with each other when the cap portion and the pipette portion are coupled to each other.

7. The contents container of claim 4, wherein the bending portion includes at least one region having a thickness greater than the space between the first edge and the second edge.

8. The contents container of claim 4, wherein the bending portion includes at least one coupling protrusion or one coupling groove on either one of an inner circumferential surface and an outer circumferential surface of the bending portion.

9. The contents container of claim 5, wherein at least one of restricting protrusions is extended along a perimeter of an inner circumferential surface of the end of the third edge.

10. The contents container of claim 9, wherein the at least one of restricting protrusions has a repeated saw-toothed shape.

11. A cosmetic contents container comprising:

a container body elongated in a first direction having a neck portion; and a discharge portion disposed to the container body, the discharge portion comprising:

a pipette portion having a bending portion, the bending portion mounted on the neck portion, a pressurizing portion communicating with the pipette portion, a cap portion having a first side and a second side, wherein the pressurizing portion is disposed to the first side, wherein the second side has a first edge extended in a second direction which is opposite to the first direction, and a second edge is extended in the second direction, wherein the first edge has a first diameter, and the second edge has a second diameter, and the first diameter is smaller than the second diameter, and wherein the bending portion is detachably attached to a groove defined between the first edge and the second edge.

12. The cosmetic container of claim 11, wherein the container body, the pipette portion, the cap portion, and the pressurizing portion are made of the same type of polypropylene (PP)-based materials, and the pressurizing portion is made of the polypropylene (PP)-based materials mixed with polyolefin elastomers (POE) having a higher elasticity compared to the container body, the pipette portion, and the cap portion.

13. The cosmetic container of claim 11, wherein a coupling portion to be coupled to the cap portion is disposed on one end of the pipette portion, the coupling portion comprises:

a mounting portion expending normal to the first direction along an edge of the one end of the pipette portion and having an outer diameter greater than an inner diameter of the neck portion, and the bending portion extending in the first direction from the mounting portion.

14. The cosmetic container of claim 11, wherein the bending portion includes at least one region having a thickness greater than the groove between the first edge and the second edge.

15. The cosmetic container of claim 11, wherein the cap portion further comprises a third edge disposed to be spaced outward apart from the second edge and extending in the second direction, and wherein the cap portion is coupled to the neck portion, and an end of the third edge is mounted on one end of the container body.

16. The cosmetic container of claim 11, wherein at least one of restricting protrusions is extended along a perimeter of an inner circumferential surface of the end of the third edge.

17. The cosmetic container of claim 16, wherein the at least one of restricting protrusions has a repeated saw-toothed shape.

18. The cosmetic container of claim 11, wherein the bending portion includes at least one coupling protrusion or one coupling groove on either one of an inner circumferential surface and an outer circumferential surface of the bending portion.

* * * * *